US007162885B2

(12) United States Patent
Sakanoue et al.

(10) Patent No.: US 7,162,885 B2
(45) Date of Patent: Jan. 16, 2007

(54) SHOWCASE

(75) Inventors: Kenji Sakanoue, Gyouda (JP); Koji Hayase, Ota (JP); Kazuo Tetsukawa, Sawa-gun (JP); Shinya Onai, Sawa-gun (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 106 days.

(21) Appl. No.: 10/991,394

(22) Filed: Nov. 19, 2004

(65) Prior Publication Data

US 2005/0115261 A1 Jun. 2, 2005

(30) Foreign Application Priority Data

Nov. 28, 2003 (JP) ..... 2003-399212

(51) Int. Cl.
*A47F 3/04* (2006.01)

(52) U.S. Cl. ..... 62/255

(58) Field of Classification Search ..... 62/255–256
See application file for complete search history.

(56) References Cited

U.S. PATENT DOCUMENTS

| | | | | | |
|---|---|---|---|---|---|
| 2,686,405 | A | | 8/1954 | Pichler | 62/89.5 |
| 3,548,610 | A | * | 12/1970 | Kynoch et al. | 62/256 |
| 3,827,254 | A | * | 8/1974 | MacMaster et al. | 62/256 |
| 4,308,726 | A | * | 1/1982 | Perez et al. | 62/256 |
| 4,393,664 | A | | 7/1983 | Wallace | 62/256 |
| 4,600,252 | A | * | 7/1986 | Barber | 312/263 |
| 4,603,557 | A | * | 8/1986 | Halbmann | 62/255 |
| 4,630,451 | A | * | 12/1986 | Kishimoto | 62/247 |
| 4,938,034 | A | * | 7/1990 | Rosanio et al. | 62/256 |
| 5,499,513 | A | | 3/1996 | Bustos | 62/252 |
| 5,761,922 | A | * | 6/1998 | Tamai et al. | 62/256 |

FOREIGN PATENT DOCUMENTS

| | | |
|---|---|---|
| EP | 0962729 | 12/1999 |
| JP | 5-203332 | 8/1993 |

OTHER PUBLICATIONS

European Search Report dated Feb. 1, 2005.

* cited by examiner

*Primary Examiner*—William E. Tapolcai
(74) *Attorney, Agent, or Firm*—Armstrong, Kratz, Quintos, Hanson & Brooks, LLP

(57) ABSTRACT

There is provided a showcase which can expand a goods mounting area of a rack within a range of no interference with cooling in a display room. The showcase comprises a display room surrounded with a transparent wall supported by support pillars erected at four corners of a bottom frame, and a door, a rack hung in the display room to display goods, a cold air outlet formed on one side of the bottom frame, and a cold air inlet formed on the other side of the bottom frame. A space between the transparent wall of the other side of the display room and the rack is narrower than a space between the transparent wall of one side of the display room and the rack.

2 Claims, 9 Drawing Sheets

SHOWCASE

BACKGROUND OF THE INVENTION

The present invention relates to a showcase which comprises a display room surrounded with a transparent wall.

The showcase of such a type has conventionally been constituted in a manner that by mounting a left/right and rear transparent wall and a front-transparent door (transparent wall) to support pillars erected at four corners of a bottom frame, the display room surrounded with the transparent walls is disposed in a main body. Then, a structure has been employed in which a net rack for displaying goods is hung in the display room, and cold air is discharged from one side of the bottom frame, the cold air is sucked from the other side to circulate in the display room, thereby cooling the display room to a predetermined temperature (e.g., Japanese Patent Application Laid-Open No. 5-203332).

In the showcase which comprises the display room surrounded with the transparent walls, because of the structure in which the cold air is discharged from one side of the bottom frame, and sucked from the other side to circulate in the display room, a space must be formed to raise the cold air between one side of the net rack and the transparent wall, and a space must be formed to lower the cold air between the other side of the net rack and the transparent wall. Consequently, there is a problem that a goods mounting area of the net rack is limited in a limited installation space.

SUMMARY OF THE INVENTION

The present invention has been made to solve the aforementioned conventional technical problems, and it is an object of the invention to provide a showcase which can expand a goods mounting area within a range of no interference with cooling in a display room.

A first aspect of the present invention is directed to a showcase comprising a display room surrounded with a transparent wall supported by support pillars erected at four corners of a bottom frame; a rack hung in the display room to display goods; a cold air outlet formed on one side of the bottom frame; and a cold air inlet formed on the other side of the bottom frame, wherein a space between the transparent wall of the other side of the display room and the rack is narrower than a space between the transparent wall of one side of the display room and the rack.

A second aspect of the present invention is directed to the above showcase, wherein the transparent wall positioned on a front surface is an openable front door and outer surface positions of the transparent walls positioned on a rear surface are similar in a case in which the transparent wall positioned on the rear surface is a fixed transparent wall and in a case in which the rear transparent wall is a openable rear door.

A third aspect of the present invention is directed to the above showcase, wherein each of the support pillars is made of s hard synthetic resin, a wiring receiving portion for electric components is formed in the support pillar, and a fin piece made of a soft synthetic resin is integrally formed in an opening of the wiring receiving portion.

DETAILED DESCRIPTION OF THE PREFERRED EMBODIMENTS

Next, the preferred embodiments of the present invention will be described in detail with reference to the accompanying drawings. A showcase 1 of the embodiments is installed at a store such as a supermarket or a convenience store to sell plastic-bottled drinks or canned drinks in a cooled (or warmed) state.

Embodiment 1

Figure 1:
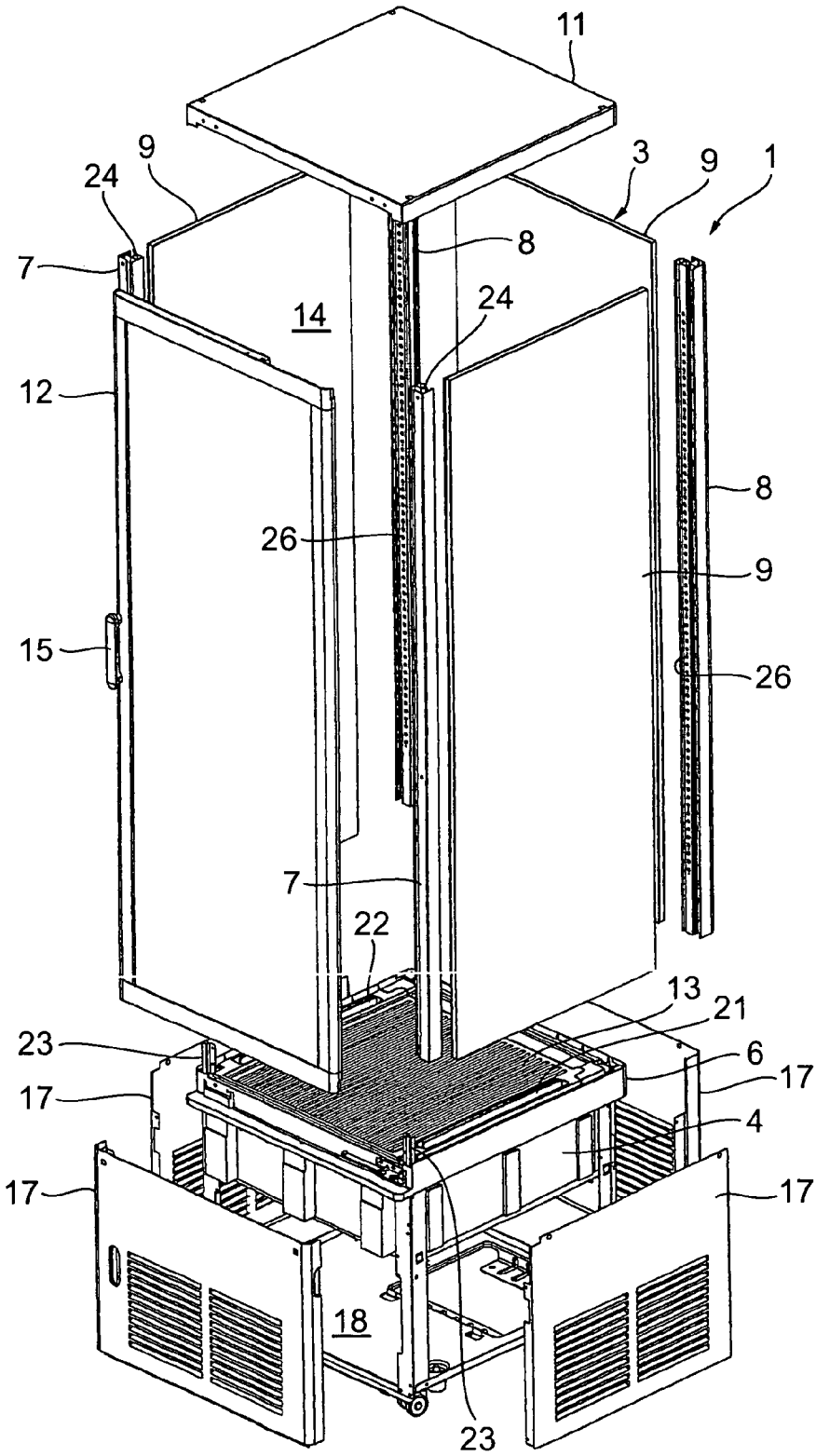
FIG. 1 is an exploded perspective view of a showcase of an embodiment of the present invention (Embodiment 1)
Figure 2:
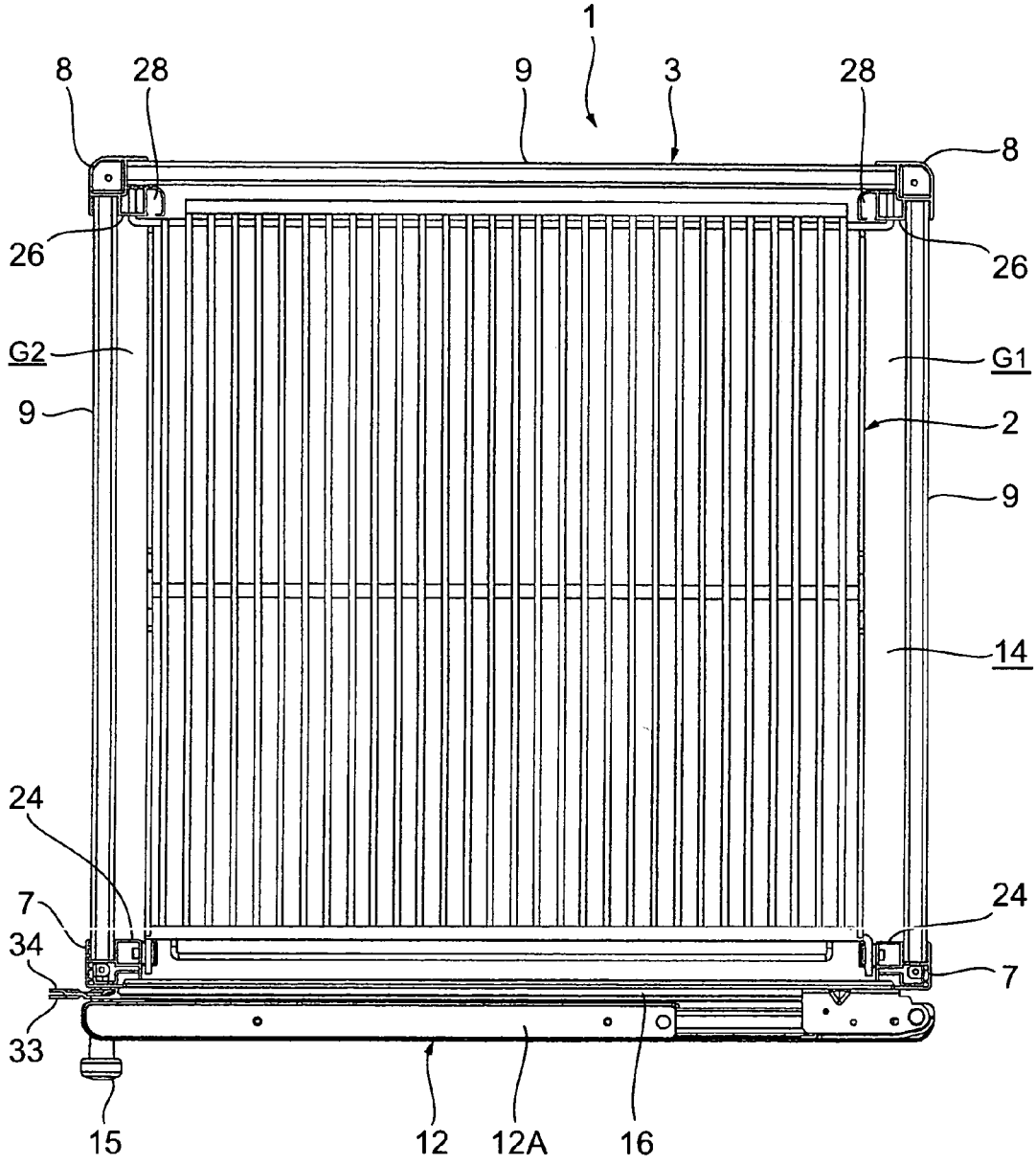
FIG. 2 is a plan view of the showcase of FIG. 1 excluding a ceiling wall.
Figure 3:
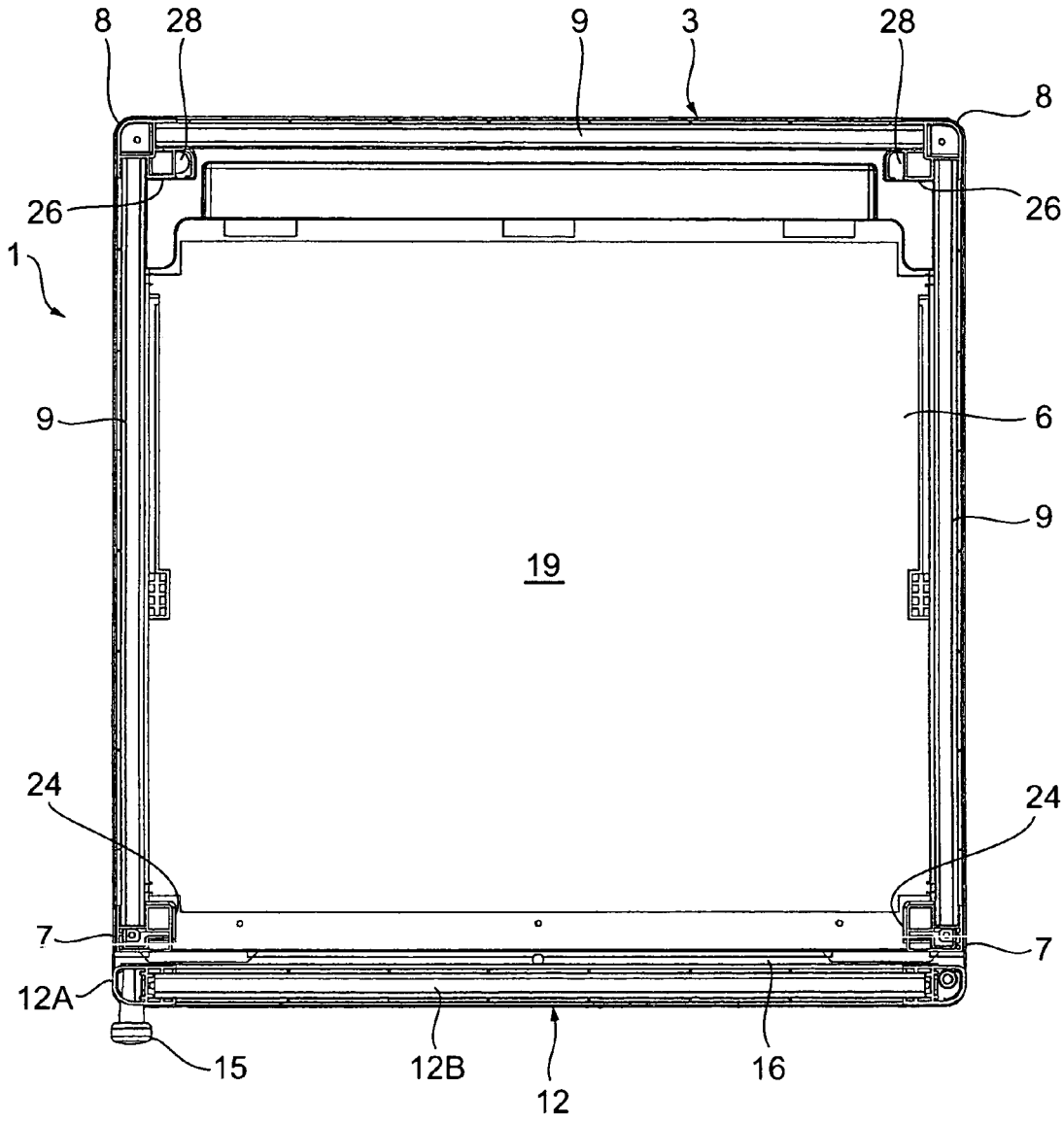
FIG. 3 is a plan view of the showcase of FIG. 1 excluding the ceiling wall, a net rack and a bottom plate.

FIG. 1 is an exploded perspective view of the showcase 1 according to Embodiment 1 of the present invention, FIG. 2 is a plan view of the showcase 1 in a state in which a ceiling wall 11 is removed, and FIG. 3 is a plan view corresponding to FIG. 2 in a state in which the ceiling wall 11, a net rack 12 and a bottom plate 13 are removed. A main body 3 of the showcase 1 of the embodiment comprises an insulated wall 4 made of foamed polyurethane, a bottom frame 6 made of a hard synthetic resin and mounted to an upper surface of the insulated wall 4, front support pillars 7, 7 and rear support pillars 8, 8 erected at four corners of the bottom frame 6, left and right and rear longitudinal transparent walls 9, 9, and 9 made of transparent double glass which are supported by the support pillars 7, 7, and 8, 8, and the ceiling wall 11.

A longitudinal door 12 (front door) as a transparent wall in which transparent double glass 12B is fitted into a surrounding sash 12A is pivotally supported by the right front support pillar 7 to rotate. In the main body 3, a display room 14 is constituted by being surrounded with the transparent walls 9, 9, and 9, the door 12, the ceiling wall 11, the bottom frame 6, and the center bottom plate 13. The door 12 closes a front opening of the display room 4 to be freely opened. A reference numeral 15 is a grip mounted to a center front in an up-and-down direction (longitudinal direction) of a non-pivotal supporting side (left side) of the sash 12A. A reference numeral 16 is a magnet gasket positioned around the front opening of the display chamber 14 and mounted to the main body 3, and bonded to the door 12 to seal it when the door 12 is closed.

A machine chamber 18 around which panels 17 are mounted is constituted below the insulated wall 4. A compressor and a condenser (not shown) are installed to constitute a refrigerant circuit of a cooling device in the machine chamber 18. A cooling chamber 19 whose upper surface is open is constituted in the insulated wall 4 (FIG. 3). A cooler and a blower (not shown) which constitute the refrigerant circuit are installed in the cooling chamber 19. The bottom plate 13 is made of a hard synthetic resin similar to that of the bottom frame 6, and detachably mounted to the bottom frame 6 to close the upper opening of the cooling chamber 19. The bottom plate 13 is detachably mounted to the bottom frame 6 for assembling workability and maintenance. Depending on designing, however, they may be formed integrally. Irrespective of separate/integral formation, the bottom plate 13 constitutes a part of the bottom frame 6.

A cold air outlet 21 is integrally formed from the front to the deep side on the right of the bottom plate 13. A cold air inlet 22 is integrally formed from the front to the deep side on the left. The cold air inlet 22 is communicated with a cold air suction side of the cooler in the cooling chamber 19, and the cold air outlet 21 is communicated with a cold air discharge side. Angles 23 are erected from the four corners of the bottom frame 6 (FIG. 1 shows front corners only). The front support pillars 7, 7 and the rear support pillars 8, 8 are connected to the angles 23 to be erected.

Shelf supports 24, 26 having a plurality of engaging holes formed up and down are integrally formed in the front support pillars 7, 7 and the rear support pillars 8, 8. Rear left and right sides are inserted and engaged with the engaging holes of the shelf supports 26, 26 of the rear support pillars 8, 8, and front left and right sides are fixed by screws to the engaging holes of the shelf supports 24, 24 of the front support pillars 7, 7, whereby a net rack 2 for displaying goods is hung in the display chamber 14. Incidentally, the net rack 2 is disposed at one state or a plurality of stages according to a use form.

The net rack 2 is made of a wire of a steel material, or a hard synthetic resin, and formed roughly into a rectangular shape. Corresponding spaces G1, G2 are constituted above the cold air outlet 21 and the cold air inlet 22 between the right side and the right transparent wall 9 and between the left side and the left transparent wall 9. In this case, a center of the left and right direction of the net rack 2 is displaced to the left (cold air inlet 22 side), and its mounting area is expanded to the left (cold air inlet 22 side), whereby the space G2 corresponding to a portion above the cold air inlet 22 is narrower than the space G1 corresponding to a portion above the cold air outlet 21. Incidentally, the space G1 of FIG. 2 is similar to that in the left/right side of the net rack of the conventional showcase.

Figure 4:
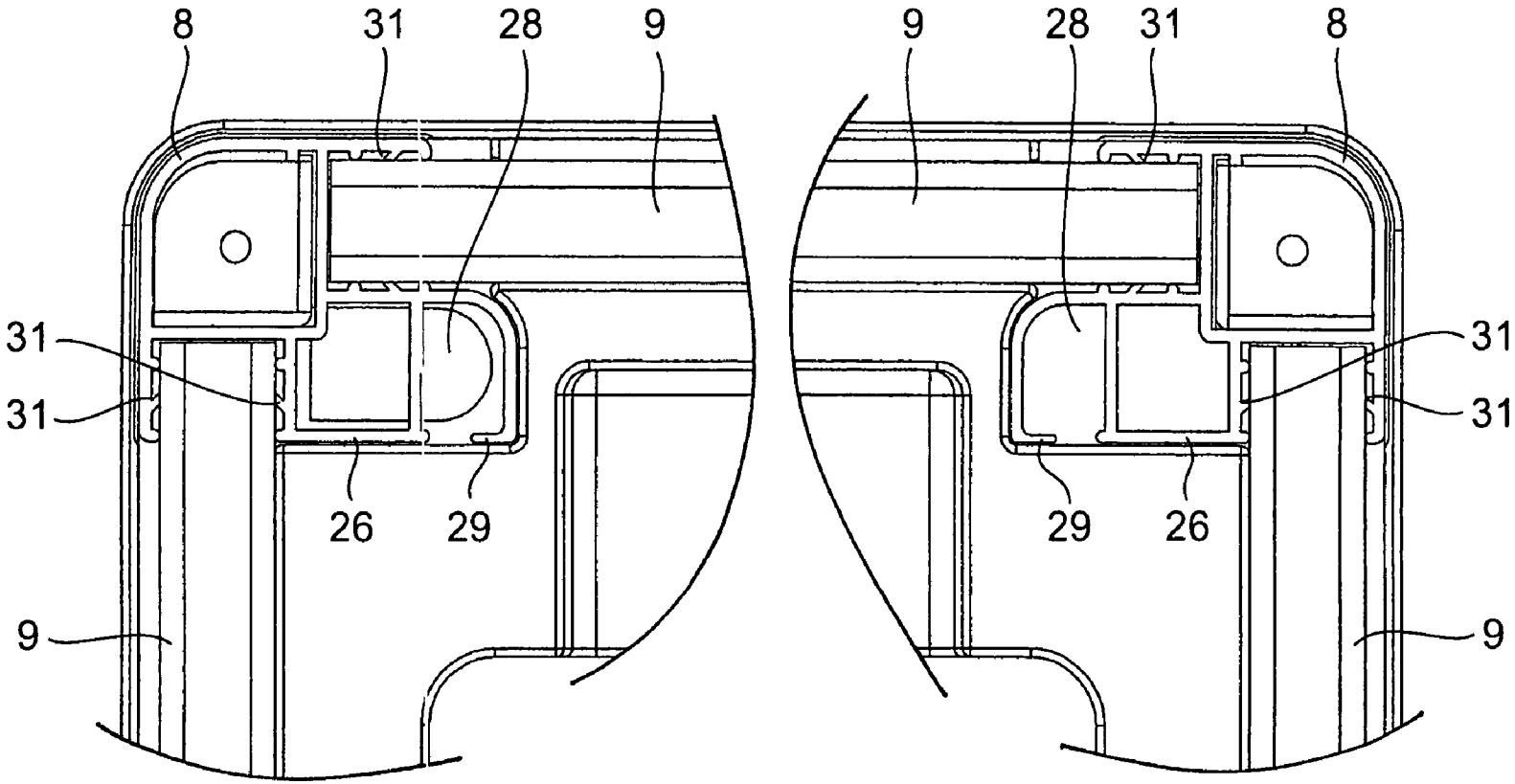
FIG. 4 is an expanded view of a rear portion of FIG. 3.

In the rear support pillar 8, as shown in FIG. 4, a wiring receiving portion 28 is integrally formed inside the shelf support 26 (right side of the left rear support pillar 8, the left side of the right rear support pillar 8). The wiring receiving portion 28 receives a wiring for supplying power to a fluorescent lamp (illuminator, not shown) mounted to an inner surface upper end of the door 12. A front of the wiring receiving portion 28 is opened up and down, and a fin piece 29 made of a soft synthetic resin is integrally formed to narrow the opening in the rear support pillar 8 by double extrusion molding. When the wiring is received in the wiring receiving portion 28, the fin piece 29 is pushed aside to insert the wiring through the opening. After the insertion, the fin piece 29 returns to narrow the opening. Thus, the wiring is prevented from coming out through the opening.

A soft fin piece 31 is additionally formed integrally in the rear support pillar 8 (similar in the case of the front support pillar 7) to adhere to the transparent wall 9, whereby sealing and holding performance of the transparent wall 9 are secured. A heat insulating material (not shown) is mounted in the ceiling wall 11, and a groove for drawing around the wiring is formed in the heat insulating material. The wiring raised from the machine chamber 18 in the wiring receiving portion 28 of the rear support pillar 8 is passed through the groove to reach the fluorescent lamp of the door 12. In other words, no coupler is disposed between the fluorescent lamp and the wiring. The pivotal supporting side of the door 12 can be reversed left and right (pivotally supported on the right according to the embodiment), and the grooves of the ceiling wall 11 are symmetrically formed left and right to deal with reversal of the door 12.

On the other hand, a locking device 32 is disposed in the showcase 1. The locking device 32 comprises main body side key metal fittings 33 mounted to the vicinity of the center of the up-and-down direction (longitudinal direction) of the left front support pillar 7 which constitutes the main body 3, door side key metal fittings 34 mounted to the-inner surface (side opposite the grip 15) in the vicinity of the center of the up-and-down direction (longitudinal direction) of the non-pivotal support side (left in a closed state) of the sash 12A of the door 12, and a lock 36 (FIG. 2, and FIGS. 5 to 9).

Figure 5:
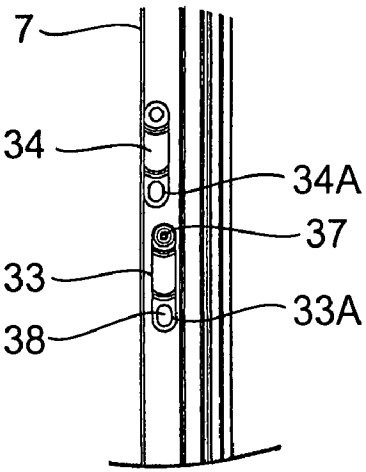
FIG. 5 is an expanded front view of a locking device portion of the showcase of FIG. 1.

Both key metal fittings 33, 34 are made of similarly shaped nonmagnetic plates of stainless steel or the like, and upper ends thereof are mounted to the front support pillar 7 and the sash 12A by screws 37 to rotate. In this case, the door side key metal fittings 34 are positioned above the main body side key metal fittings 33, usually drooped as shown in FIG. 5 (during nonuse), and positioned in a space between the main body 3 and the door 12 without mutual overlap thereof in the drooped state (In FIG. 5, the door side key metal fittings 34 are virtual). Such arrangement eliminates the necessity of expanding the space between the main body 3 and the door 12.

Figure 8:
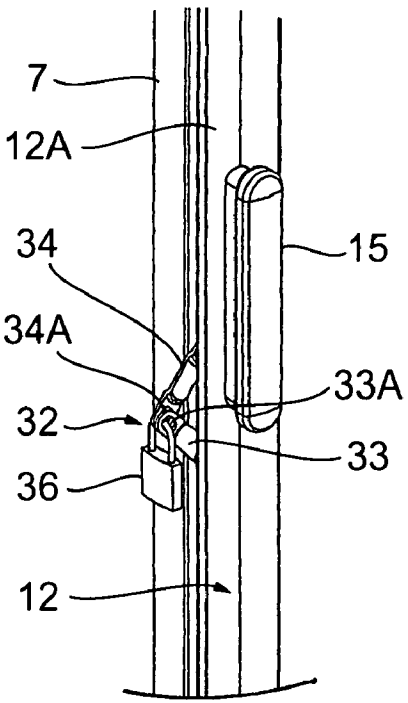
FIG. 8 is similarly expanded perspective view of the locking device portion of the showcase of FIG. 1 in the locked state.
Figure 7:
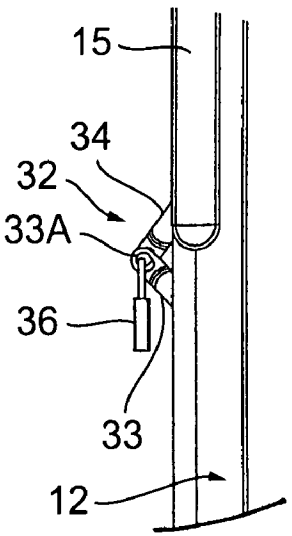
FIG. 7 is an expanded front view of the locking device portion of the showcase of FIG. 1 in the locked state.
Figure 9:
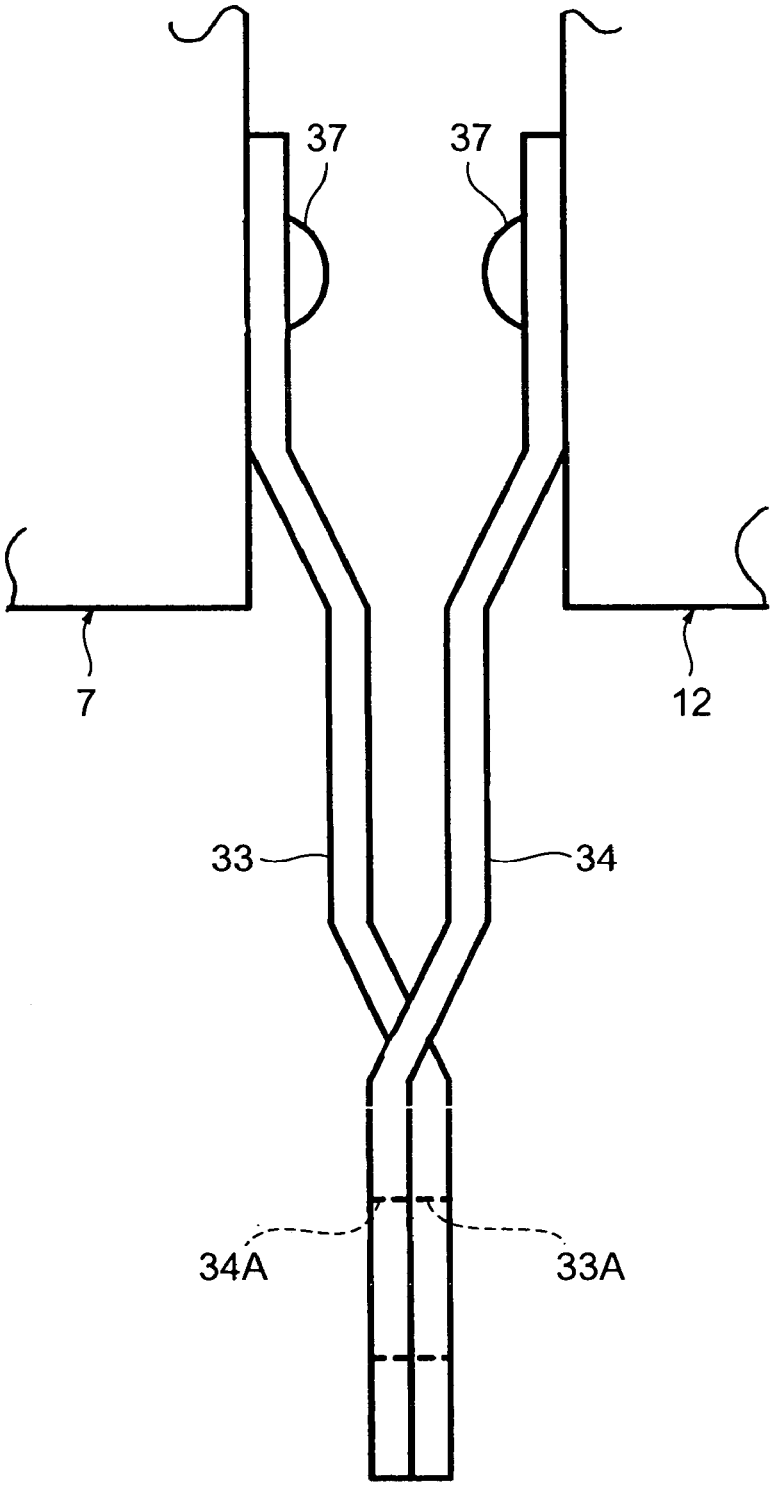
FIG. 9 is a plan view of metal fittings of each key of the locking device of the showcase of FIG. 1.

Additionally, as shown in FIG. 9, the main body side key metal fittings 33 are bent to the front into stair-form, and through-holes 33A are formed in tips thereof. The door side key metal fittings 34 are bent to the rear side into stair form (main body side key metal fittings 33 are reversed and used), and through-holes 34A are similarly formed in tips thereof. When the door 12 is locked as described later, the door side key metal fittings 34 are rotated obliquely downward left while the door 12 is closed, and the main body side key metal fittings 33 are rotated obliquely upward left. The tips thereof are accordingly protruded from the space between the main body 3 and the door 12 outward (left), and the through-holes 33A, 34A match each other outward (left) from the space between the main body 3 and the door 12 (FIGS. 7, 8). At this time, the tips of the main body side key metal fittings 33 come into close contact with the door 12 side (front side) of the tips of the door side key metal fittings 34 (FIG. 9).

A projection 38 is formed in the front of the front support pillar 7, with which the through-hole 33A of the main body side key metal fittings 33 of the drooped projection (not shown) is formed in the sash 12A of the door 12, which is engaged with the through-hole 34A of the door side key metal fittings 34 of the drooped state to be freely disengaged. Accordingly, the key metal fittings 33, 34 are maintained in the drooped states against shocks or a centrifugal force during the rotation of the door 12.

According to the foregoing constitution, when the compressor of the machine chamber 18 and the blower of the cooling chamber 19 are run, the cooler exhibits a cooling operation, and cold air heat-exchanged with the cooler is discharged from the right cold air outlet 21 upward by the blower. The cold air discharged from the cold air outlet 21 rises through the space G1 between the net rack 2 and the right transparent wall 9, lowers through the left space G2, and is sucked from the cold air inlet 22 to circulate in the display room 14. Thus, the goods on the net rack 2 hung in the display chamber 14 are cooled to a predetermined temperature.

At this time, because of the expansion of the left side of the net rack 2 as described above, the space G2 is narrower than the space G1. However, since the space G2 is a path through which the cold air after cooling in the display room 14 lowers, the cold air easily lowers by gravity, and cooing performance is not deteriorated.

Figure 6:
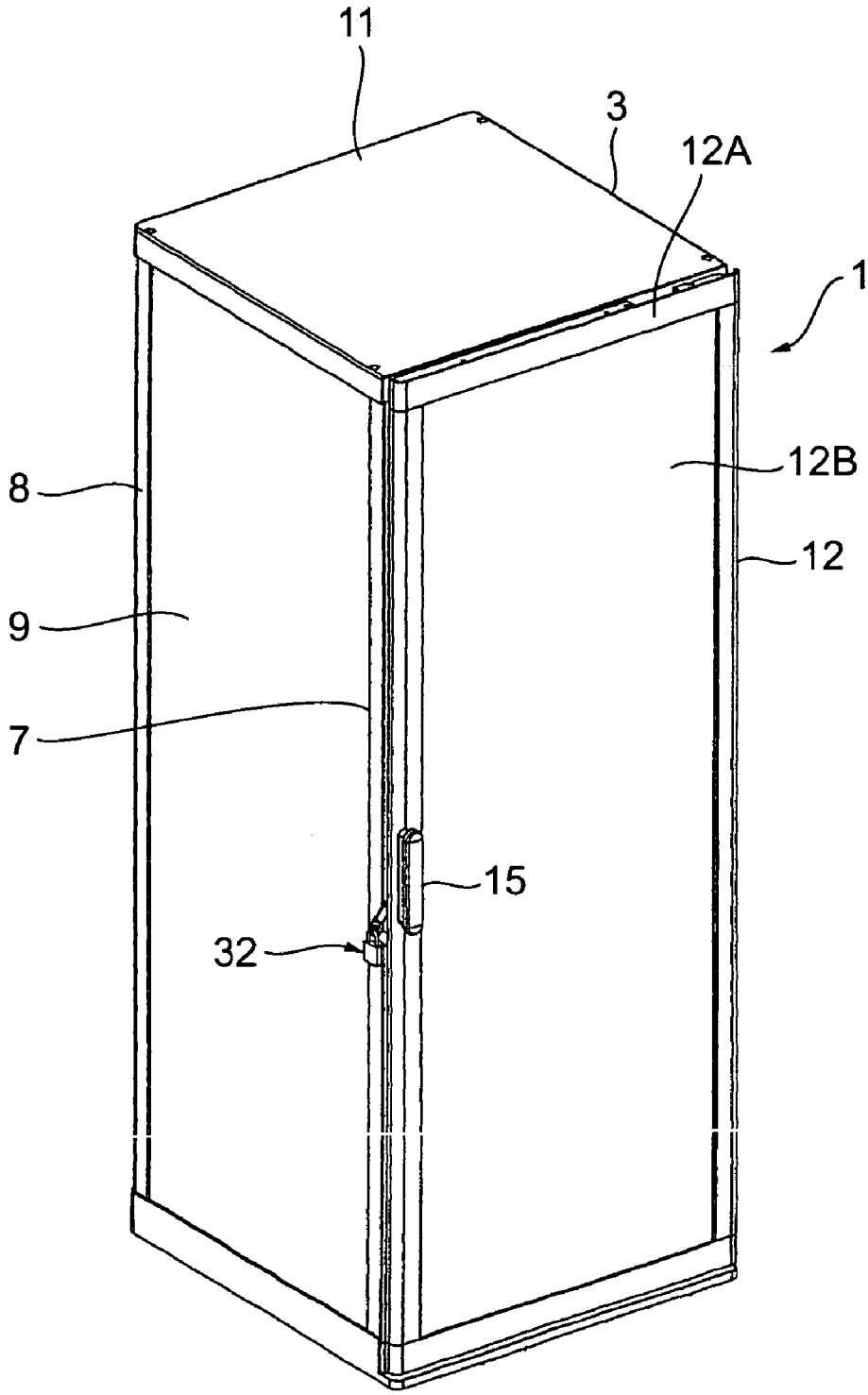
FIG. 6 is an upper perspective view of the showcase of FIG. 1 in a locked state.

Next, when the door 12 of the showcase 1 is locked at the time of closing the store, the door 12 is closed as rotated obliquely downward left, the main body side key metal fittings 33 are rotated obliquely upward left, and the through-holes 33A, 34A are matched with each other as described above. A hook of the lock 36 is inserted through each of the through-holes 33A, 34A in this state to lock the door (FIGS. 6, 7, and 8).

In this case, since the tips of the main body side key metal fittings 33 are brought into close contact with the door 12 side (front side) of the tips of the door side key metal fittings 34, no so-called backlash (movement in the hook of the lock 36) of both key metal fittings 33, 34 occurs in the locked state.

Because of the constitution of the locking device 32, the key metal fittings 33, 34 are protruded to the outside from the space between the main body 3 and the door 12 at the time of locking, and usually stored in the gap between the main body 3 and the door 12. Thus, an appearance is not damaged, and the key metal fittings 33, 34 are not obstacles during normal door opening/closing. Especially, because of the simple structure in which the key metal fittings 33, 34 are mounted to the main body 3 or the door 12 to rotate, no cost increase occurs.

Furthermore, since the key metal fittings 33, 34 are made of nonmagnetic materials, no reduction occurs in a magnetic force of the magnet gasket 16. Especially, since the key metal fittings 33, 34 of the locking device 32 are mounted to the main body 3 in the vicinity of the center of the non-pivotal support side of the door 12 or the door 12, bending of the upper and lower ends of the door 12 in the locked state can be limited to a minimum, whereby safety can be improved more.

Embodiment 2

Figure 10:
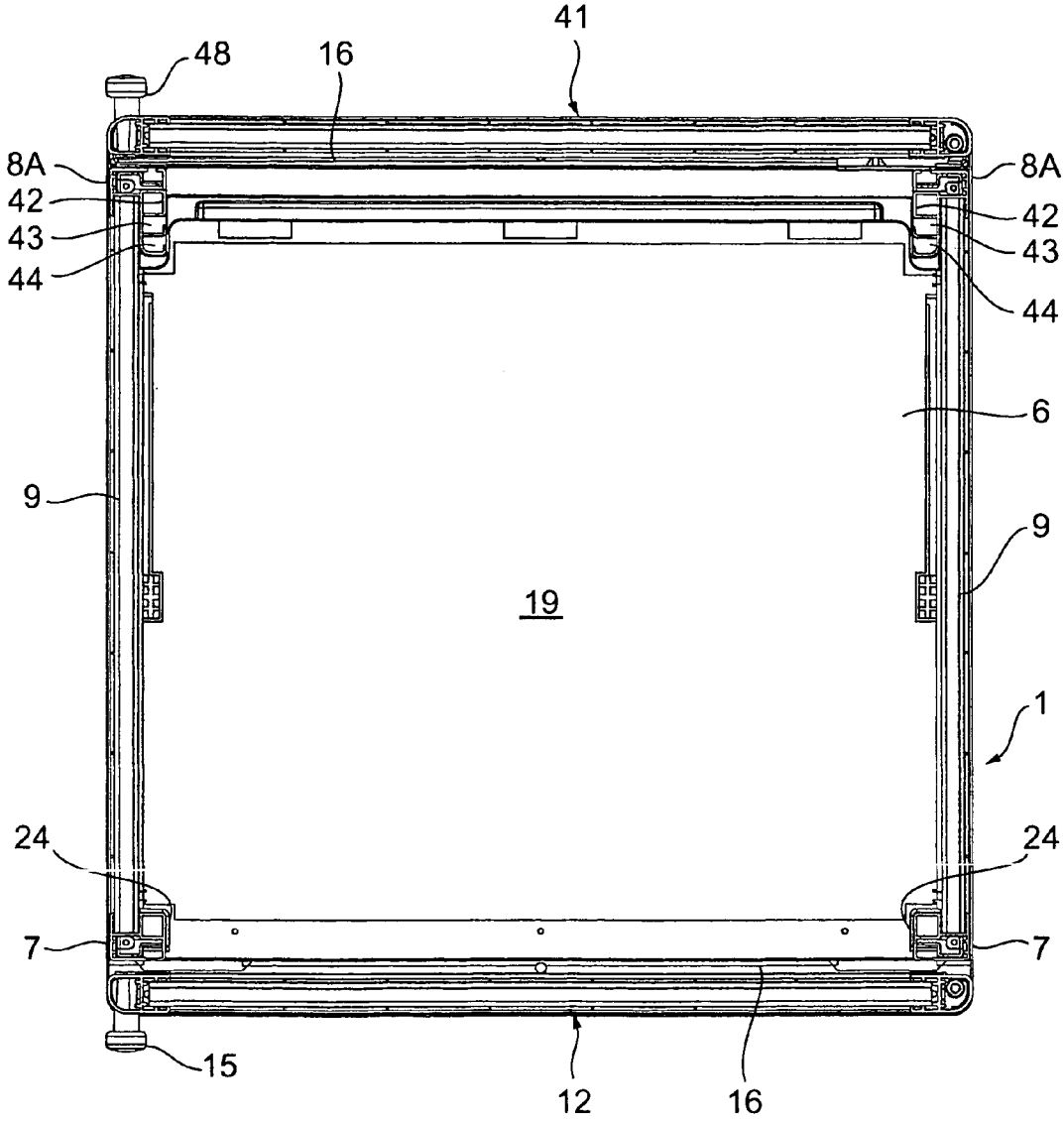
FIG. 10 is a plan view of a showcase of another embodiment of the invention excluding a ceiling wall, a net rack and a bottom plate (Embodiment 2)
Figure 11:
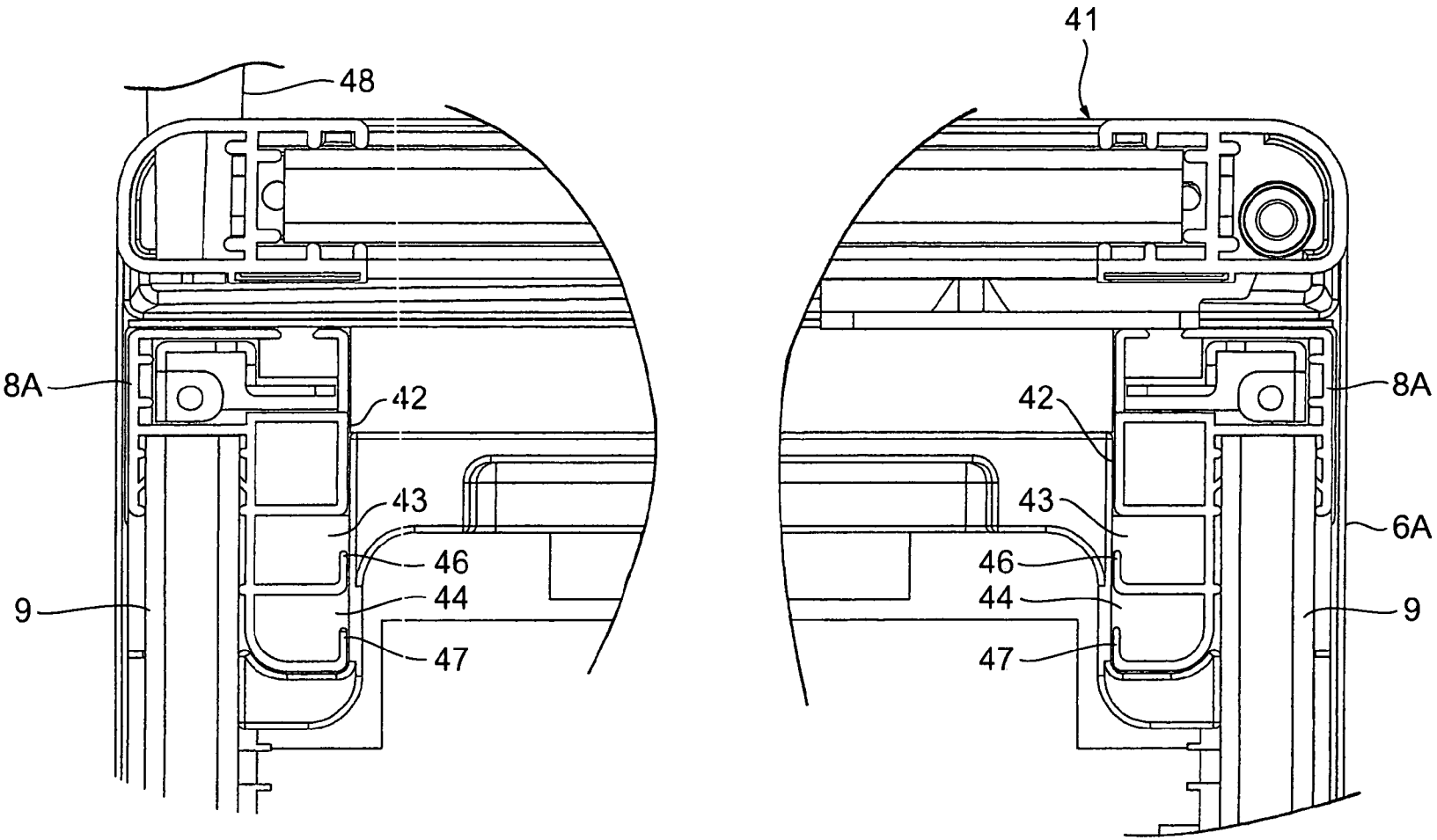
FIG. 11 is an expanded view of a rear portion of FIG. 10.

FIGS. 10, 11 show another embodiment of the showcase 1 of the invention. Components denoted by reference numerals similar to those of FIGS. 1 to 9 are similar to those of the same. In this case, the showcase 1 of the embodiment is constituted in a manner that front and rear surfaces of a display room 14 are opened, and the openings of the front and rear surfaces comprise doors. Main differences from the previous embodiment are shapes of a bottom frame and a rear support pillar, and a door mounted in place of the rear transparent wall. In this case, the bottom frame is denoted by a reference numeral 6A, the rear support pillar by 8A, and the door of the rear surface (rear door) by 41. The bottom frame 6A is formed into a shape capable of erecting rear support pillars 8A, 8A at rear four corners by inserting a core into the same mold as that of the bottom frame 6.

To mount the door 41 in the same size and to secure an aperture of a rear opening of the display room 14, the rear support pillar 8A is moved to the front side (door 12 side) to be mounted, and a shape thereof is different from that of the aforementioned rear support pillar 8. That is, in this case, the rear support pillar 8A exhibits a shape roughly similar to that of the front support pillar 7, and wiring receiving portions 43, 44 are disposed side by side on two places of the front side in addition to a similar shelf support 42. In openings of the wiring receiving portions 43, 44, fin pieces 46, 47 made of soft synthetic resins are integrally formed by double extrusion. In this case, the wiring receiving portions 43, 43, and 44, 44 receive wiring for an electric heater when the display room 14 is heated to be used in addition to the wiring of the aforementioned fluorescent lamp.

The door 41 is similar in structure to the front door 12, and an outer surface thereof excluding a grip 48 comes to the same position as that of the outer surface of the rear transparent wall 9 of the showcase 1 of FIG. 1 (same outer size) because of the movement of the rear support pillars 8A, 8A to the front side. Accordingly, substantially similar sizes are realized between the case of one door in FIG. 1 and the case of two front and rear doors in FIG. 10 to improve handling performance during transportation and storage. It is to be noted that the aforementioned locking device 32 is disposed also in the door 41.

As discussed above in detail, according to the present invention, the showcase comprises the display room surrounded with the transparent wall supported by the support pillars erected at the four corners of the bottom frame, the net rack hung in the display room to display goods, the cold air outlet formed on one side of the bottom frame, and the cold air inlet formed on the other side of the bottom frame. The space between the transparent wall of the other side of the display room and the net rack is narrower than the space between the transparent wall of one side of the display room and the net rack. Thus, a goods mounting area of the net rack can be expanded, and goods display efficiency can be improved.

In this case, since it is the space of the lowering side of the cold air in the display room that is narrowed by the expansion of the net rack, the cold air lowers by gravity, and almost no adverse influence occurs on cooing performance.

According to the invention, the transparent wall positioned on the front surface is an openable front door and outer surface positions of the transparent walls positioned on the rear surface are similar in the case in which the transparent wall positioned on the rear surface is a fixed transparent door and in the case in which the rear transparent wall is an openable rear wall. Thus, packages are similar between the case of one door and the case of two doors during transportation or storage, and installation spaces are similar, whereby handling is easy.

Furthermore, according to the invention, each of the support pillars is made of s hard synthetic resin, and the wiring receiving portion for electric components is electric component such as an illuminator or an electric heater can be received in the wiring receiving portion without any problems. Especially, since the fin piece made of a soft synthetic resin is integrally formed in the opening of the wiring receiving portion, it is possible to effectively prevent falling-off while securing wiring reception.

What is claimed is:

1. A showcase, comprising:

a display room surrounded with a transparent wall supported by support pillars erected at four corners of a bottom frame;

a rack hung in the display room to display goods;

a cold air outlet formed on one side of the bottom frame; and a cold air inlet formed on the other side of the bottom frame, wherein a space between the transparent wall of the other side of the display room and the rack is narrower than a space between the transparent wall of one side of the display room and the rack and wherein each of the support pillars is made of a hard synthetic resin, a wiring receiving portion for electric components is formed in the support pillar, and a fin piece made of a soft synthetic resin is integrally formed in an opening of the wiring receiving portion.

2. A showcase comprising:

a display room surrounded with a transparent wall supported by support pillars erected at four corners of a bottom frame;

a rack hung in the display room to display goods;

a cold air outlet formed on one side of the bottom frame; and a cold air inlet formed on the other side of the bottom frame, wherein a space between the transparent wall of the other side of the display room and the rack is narrower than a space between the transparent wall of one side of the display room and the rack, the transparent wall positioned on a front surface is an openable front door, outer surface positions of the transparent walls positioned on a rear surface are similar in a case in which the transparent wall positioned on the rear surface is a fixed transparent wall and in a case in which the rear transparent wall is an openable rear door, and wherein each of the support pillars is made of a hard synthetic resin, a wiring receiving portion for electric components is formed in the support pillar, and a fin piece made of a soft synthetic resin is integrally formed in an opening of the wiring receiving portion.

* * * * *